United States Patent [19]

Rutzel et al.

[11] Patent Number: 4,462,544

[45] Date of Patent: Jul. 31, 1984

[54] BEVERAGE SIPPER

[76] Inventors: Alois E. Rutzel, R.R. #2, Moores Hill, Ind. 47032; Stefan Rützel, Thurëngerstr. 10, 8784 Burgsinn (Ufr) Bavaria, Fed. Rep. of Germany

[21] Appl. No.: 394,274

[22] Filed: Jul. 1, 1982

[51] Int. Cl.[3] ..... A47G 19/22

[52] U.S. Cl. ..... 239/33; 220/90.2; 215/1 A; 215/100 R

[58] Field of Search ..... 239/33; 215/1 A, 100 R; 220/90.2; 229/7 S

[56] References Cited

U.S. PATENT DOCUMENTS

| | | | |
|---|---|---|---|
| 2,052,307 | 8/1936 | Kennedy | 215/229 |
| 2,558,645 | 6/1951 | Docter | 239/33 |
| 2,581,768 | 1/1952 | O'Casey | 220/90.2 |
| 3,171,580 | 3/1965 | Davis et al. | 229/7 S |
| 3,338,564 | 8/1967 | Roeder | 229/7 |
| 4,165,814 | 8/1979 | Seel | 261/18 |

FOREIGN PATENT DOCUMENTS

| | | | |
|---|---|---|---|
| 2421990 | 11/1975 | Fed. Rep. of Germany | 220/90.2 |

*Primary Examiner*—John J. Love
*Assistant Examiner*—James Moon
*Attorney, Agent, or Firm*—Wood, Herron & Evans

[57] ABSTRACT

Device for beverage drinking for use by a plurality of drinkers. The device comprises a base mountable on a beverage container opening, such as the mouth of a beer mug with the base defining plural bores through which flexible drinking tubes extend into the container. Short posts or pegs are provided on the base onto each of which the drinking end of a tube can be placed, thus serving as a tube-retaining means when the tube is not in use. An elongate handle is additionally provided to facilitate handling of the device.

1 Claim, 2 Drawing Figures

BEVERAGE SIPPER

BACKGROUND OF THE INVENTION

This invention relates generally to drinking devices for use in the consumption of beverages, and more particularly relates to a novel device which is designed for simultaneous use by a plurality of drinkers.

In any typical social gathering of people, such as a fraternal meeting, a party, or a get-together at the neighborhood tavern, it is most common that some liquid refreshment will be consumed by those in attendance. This refreshment may be served in quantity and some volume, being contained in a punch bowl or a pitcher, for instance.

Although the use of cups or glasses supplied for each drinker is not ordinarily viewed as a problem in need of rectification, the number of cups and glasses can be reduced among a group of compatriot drinkers through the use of a drinking device used communally, whereby all can partake of the beverage directly from a single container.

An immediate problem presented by such a communal drinking device is the need for maintaining individualized access to the container in order to promote a sanitary condition in its use.

A drinking device used in common would also lend a certain amount of sport to the consuming, to the amusement of all. More practically, a drinking device to be used by a plurality of drinkers would tend to increase the consumption of beverage through its basic novelty as well as through the aforementioned sporting element induced in the drinkers. This is a consideration not lost upon the wholesalers and retailers of beverages. Additionally, such a device would serve as a ready platform for carrying advertisements for such beverages.

SUMMARY OF THE INVENTION

It is with these considerations in mind that the present invention was devised. A principal object of the invention is to provide a drinking device which can be used by a plurality of drinkers having individualized drinking means and which is simply mountable on a beverage container.

A further object is to make the device so mountable through the use of a base adapted to receive the lip of a container mouth to thereby promote stability of the apparatus, and provision of a handle for the device which facilitates mounting and handling thereof.

Yet another object is to construct the device with materials which are readily cleaned to thereby promote sanitary use.

Still another object is to make the device out of materials which promote the simple and expedient use of the device with convenient storage when the device is not in use.

These, together with other objects and advantages, are accomplished by the instant invention which provides a drinking device or beverage sipper for use by a plurality of drinkers to be used in conjunction with a beverage container having an open top, such as a beer mug. An exemplary beverage sipper comprises a base which is roughly configured to the same peripheral shape as that of the portion of the container defining the opening which the base communicates with. In a preferred form, the base is oversize so that it can be simply set in place on the container opening, such as the lip of a mug. An annular recess in the bottom of the base sized to receive such a lip facilitates mounting and promotes the overall stability of the beverage sipper.

The base has a small vertical height in which a plurality of through bores are defined in spaced relation around the base. A flexible drinking tube extends through each of the bores and into the container. A sufficient length of tubing is provided for the use of each drinker. The tubing in the preferred embodiment is made of a flexible, transparent plastic for aesthetic effect.

Since it is undesirable to have the drinking ends of the tubing left loose when not in use, tube retaining posts are provided on the base. These posts take the form of pegs fixed on the base or molded integrally therewith which are sized to permit the opening of the free end of the tube to be simply slid thereon. Tubing retained in this manner adds to the appearance of the device while also facilitating storage of the beverage sipper.

A handle is additionally provided for the base to facilitate mounting of the beverage sipper on the beverage container opening. The handle, which is elongate and extends substantially vertically from the center of the top surface of the base, in the preferred embodiment, promotes easy handling of the apparatus in general.

Cleaning of the beverage sipper is simply accomplished through known techniques, such as immersion of the entire device in a suitable bath with subsequent rinsing of the drinking tubes.

Although this invention has been summarized in terms of an apparatus which is usable with any appropriate and available common beverage container, it may also be embodied in a special container adapted solely for use with the beverage sipper.

The foregoing objects and advantages as well as others will be made more fully apparent upon consideration of the invention in light of the following drawings and detailed description in which:

DETAILED DESCRIPTION OF THE PREFERRED EMBODIMENT

Figure 1:
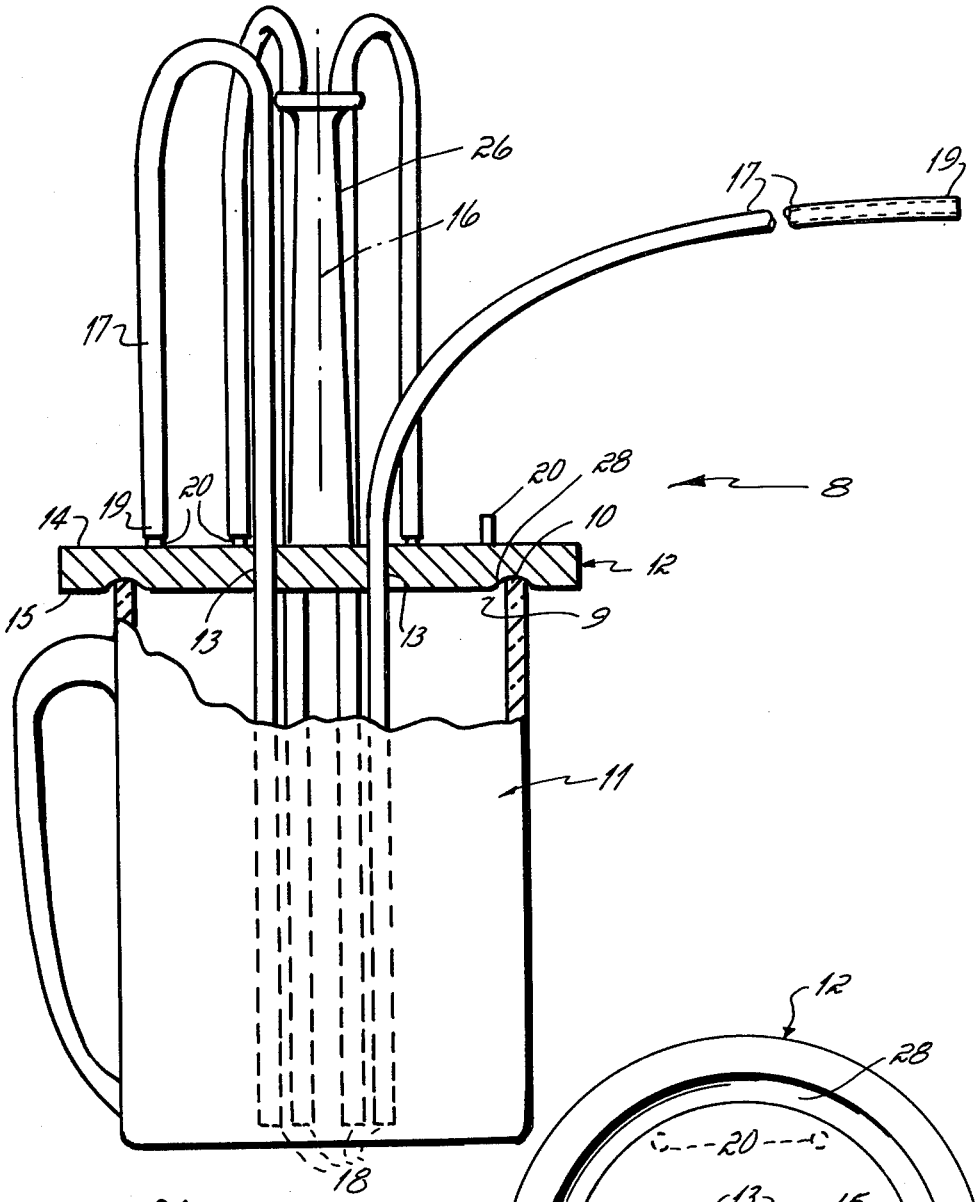
FIG. 1 is an elevational view partly in section showing the beverage sipper of this invention mounted on a beverage container.

Referring now in particular to FIG. 1, the beverage sipper of this invention is generally indicated at 8 and is shown mounted upon an appropriate beverage container, such as an oversized beer mug 11 having an opening 9 defined by a lip 10.

The beverage sipper comprises a base 12 which has a plurality of holes or bores 13 formed therein. The base has a generally planar surface 14 and a bottom generally planar surface 15 through and between which the bores 13 pass. In its preferred form, the base 12 has a small vertical height and is configured such that its periphery roughly corresponds to the general shape of the periphery of the beverage container 11 which is a circular projection in this instance. The base 12 is, therefore, substantially disc-shaped, with a vertical axis 16 extending roughly through its center.

The base 12 can be made of any suitable inexpensive material, such as wood or plastic through which the bores 13 can be drilled or formed by molding. It is advantageously made in the above-described disc-shaped form which is simple yet pleasing in design. The shape of the base 12 of course is no limitation herein, since neither the top surface 14 nor the bottom surface 15 need be planar, nor need the base 12 itself be solid in vertical thickness, its major attribute being its simple mountability over the container opening 9.

Preferably, the bores 13 through the base 12 are spaced apart from one another and generally located nearer the axis 16 than the peripheral edge of the base. In the preferred form, the bores 13 are radially spaced an equal distance from the axis 16 of the base in even spaced relation around that axis.

A flexible drinking tube 17 extends through each of the bores 13 into the container 11 and into the liquid contained therein so that a drinker may imbibe the same. The tubing 17 is of sufficient length such that a first end 18 may extend into the bottom of the container with a second end 19 extending a sufficient length beyond the base 12 to promote easy sipping. It has been found advantageous to provide the tubing 17 in a transparent, flexible plastic which lends itself to the inherent novelty of this invention. Such transparent tubing also facilitates thorough cleaning of the tubing in that the interior of the drinking tube is readily observed.

For purposes of retaining the loose second, or drinking, ends 19 of each tube 17 when not in use, such as for storage, posts or pegs 20 are provided. The posts 20, which may be fixed to the base 12 or molded integral therewith, extend from the top surface 14 of the base 12 in a pattern similar to that of the bores 13. The posts 20 are located nearer the periphery of the base 12 than the bores 13 and are attached to the base in any convenient manner. The posts 20 are cylindrical and are relatively short in an axial direction. Each post has a diameter sized to be received in the opening in the drinking end 19 of the tubing 17. The end 19 of the tubing is simply slid onto and over the sides of the post 20 to be thereby releasably retained in place.

A handle 26 fixed to the base 12 permits easy handling of the beverage sipper 8, such as for washing, and further facilitates mounting of the base 12 on the container 11. The elongate handle 26 centrally fixed substantially along the axis 16 of the base lends itself to these functions as well as benefiting the general appearance of the device as a whole. The handle 26 can be simply fixed to the base such as by an appropriate rust-resistant screw 27, shown extending vertically upwardly through the bottom surface 15 of the base in FIG. 2. Alternatively, the handle 26 can be molded integral with the base 12.

Figure 2:
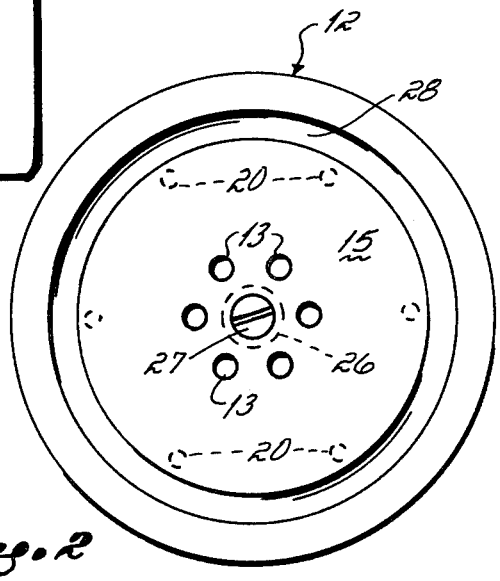
FIG. 2 is a plan view of the bottom surface of the base of the beverage sipper.

As further shown in FIG. 2, an annular recess 28 is formed in the base which receives the lip 10 defining the container opening 9 onto which the base is mounted. One or more such recesses may be provided to thereby adapt the base 12 for use on one or more beverage containers having different lip diameters. The annular recess 28 promotes positioning and centering of the beverage sipper 8 on the container 11 and also promotes general stability of the entire device.

In operation, a container 11 is provided with a quantity of appropriate beverage therein. The base 14 with the drinking tubes 17 extending therethrough a distance sufficient to reach the bottom of the container is then placed over the opening 9 of the container 11 through the use of the handle 26 such that the lip 10 of the container 11 seats within the recess 28 provided in the bottom surface 15 of the base 12. Each of the plural drinkers can employ one of the drinking tubes 17 by taking up the second or drinking end 19 of the tube and utilizing the same as a straw. When the drinker is finished, or when it is desired to store the device, the tube end 19 is placed over a retaining post 20 to thereby secure the loose end.

While the principles of this invention have been described above in connection with a specific and preferred device, it is to be clearly understood that this description is made only by way of an example and not as a limitation on the scope of the invention.

What is claimed:

1. A drinking device for a plurality of drinkers, comprising:

a beverage container, said container having a generally circular opening therein defined by a lip;

a base having a top surface, a bottom surface and a vertical axis, said base having an annular recess in said bottom surface which receives said lip to loosely seat said base thereon, said base having plural bores defined therein in spaced relation around and radially spaced from said vertical axis passing through top surface and said bottom surface;

plural elongate one-piece flexible drinking tubes extending through said bores, each of said tubes having a first and a second end, said first end extending into said container and said second end utilized by the drinker for drinking, the tubes being removable from the base;

an elongated and substantially smooth handle fixed to said base extending substantially along said vertical axis, and tube-retaining posts on said top surface in spaced relation around and radially spaced from said vertical axis for retaining said second end of said drinking tube when said tube is not being used.

* * * * *